US007117567B1

(12) United States Patent
Krulik et al.

(10) Patent No.: US 7,117,567 B1
(45) Date of Patent: Oct. 10, 2006

(54) TWO-PART CONNECTING ZIPPER PULL

(75) Inventors: Richard J. Krulik, Dix Hills, NY (US); Jason Drew, Port Jefferson, NY (US)

(73) Assignee: Briggs & Riley Travelware LLC, Hauppauge, NY (US)

( * ) Notice: Subject to any disclaimer, the term of this patent is extended or adjusted under 35 U.S.C. 154(b) by 0 days.

(21) Appl. No.: 10/778,585

(22) Filed: Feb. 12, 2004

Related U.S. Application Data

(60) Provisional application No. 60/446,982, filed on Feb. 12, 2003.

(51) Int. Cl.
*A44B 19/26* (2006.01)

(52) U.S. Cl. ..... 24/429

(58) Field of Classification Search ..... 24/429–431
See application file for complete search history.

(56) References Cited

U.S. PATENT DOCUMENTS

| | | | | |
|---|---|---|---|---|
| RE18,612 | E | 10/1932 | Siers | |
| 2,570,378 | A * | 10/1951 | Rinehart | 24/431 |
| 4,815,176 | A * | 3/1989 | Yoshida | 24/387 |
| 5,632,070 | A | 5/1997 | Wakabayashi | |
| 5,860,192 | A | 1/1999 | Chung | |
| 6,035,497 | A | 3/2000 | Jackson | |
| 6,314,625 | B1 * | 11/2001 | Ikeda | 24/429 |
| 6,532,633 | B1 | 3/2003 | Chu | |
| 6,533,335 | B1 | 3/2003 | Hudson | |
| 6,550,111 | B1 | 4/2003 | Garraffa, Jr. | |
| 6,804,867 | B1 * | 10/2004 | Oda et al. | 24/429 |
| 2002/0069494 | A1 | 6/2002 | McCrum | |
| 2002/0100149 | A1 * | 8/2002 | Davis | 24/429 |
| 2003/0079317 | A1 | 5/2003 | Oda et al. | |
| 2003/0079318 | A1 | 5/2003 | Oda et al. | |

FOREIGN PATENT DOCUMENTS

| | | | |
|---|---|---|---|
| EP | 442334 | A1 * | 8/1991 |
| JP | 2000014412 | A * | 1/2000 |
| WO | WO 8002494 | A * | 11/1980 |

* cited by examiner

*Primary Examiner*—James R. Brittain
(74) *Attorney, Agent, or Firm*—Abelman, Frayne, Schwab

(57) ABSTRACT

A two-part connecting zipper pull includes a pull tab with receiving apertures therein and a connecting aperture, a loop member having ends to be fitted into the receiving apertures, and a securing pin for removably securing the ends of the loop member into the receiving apertures. The ends have apertures which align with the connecting aperture of the pull tab for allowing the securing pin to pass therethrough. The pull tab may have ornamental indicia thereon. The pull tab is particularly useful for the repair of existing zippered items such as luggage, handbags, clothing and the like, and can be marketed for repair purposes, or for cosmetic or appearance changes of the zipper.

9 Claims, 4 Drawing Sheets

TWO-PART CONNECTING ZIPPER PULL

CROSS-REFERENCE TO PRIOR APPLICATIONS

This application claims priority to co-pending provisional application No. 60/446,982, filed Feb. 12, 2003, the disclosure of which is incorporated herein by reference and made a part of this disclosure.

BACKGROUND OF THE INVENTION

1. Field of the Invention

This invention relates to zippers, and in particular to a two-part connecting zipper pull for use with zipper sliders of zipper assemblies.

2. Description of the Related Art

Zipper pulls in the prior art are typically constructed as a monolithic element with a single loop member for attaching the zipper pull to the zipper slider of a zipper assembly. For example, zipper pulls are often fabricated from dye-pressed pot metals such as zinc and zinc alloys, or extruded plastic, as one-piece elements with the single loop member monolithically connected to the pull tab.

Typically, such zipper pulls are not removable from the zipper slider. Therefore, in the event that a portion of the pull tab breaks, the entire zipper pull may be inoperable to slide the zipper slider to fasten and unfasten the zipper assembly.

In addition, zipper pulls for use in luggage or clothing may have an ornamental pull tab to show a product logo. However, if the user desires self-expression or a change in appearance of the zipper pull of one's luggage or clothing, the user cannot change the ornamental pull tab of prior art zipper pulls, since such zipper pulls are integral with the loop member.

Two-part pull tabs or pulls attachable to slide fasteners are known, for example, as described in U.S. Pat. No. 6,035,497 to Jackson; U.S. Patent Publication Number US 2002/0069494 A1 to McCrum; U.S. Patent Publication Number US 2003/0079317 A1 to Oda; and U.S. Patent Publication Number US 2003/0079318 A1 to Oda. Each of these published U.S. patent documents are hereby incorporated herein by reference and made a part of this disclosure.

The two-part assemblies of the prior art present certain of disadvantages and leave room for improvement. For example, the zipper pull tab described in U.S. Pat. No. 6,035,497 to Jackson discloses a hook piece which is frangibly secured by an adhesive element to a zipper pull tab body, with the adhesive element being a breakaway pin on the hook piece oriented to engage an aperture located in an internally situated cavity of the zipper pull tab body. In addition to the relatively small dimensions of such breakaway pins and holes which present excessive manufacturing complexity, such securement between the hook piece and the zipper pull tab body is due to a frictional engagement between the breakaway pin and the hole in which the breakaway pin rests. Such frictional engagement is readily overcome by minimal forces, and repeated insertion and removal of the hook piece from the tab body wears the frictionally engaging surfaces. Accordingly, the zipper pull tab of the Jackson patent would have a limited lifespan before accidental disengagement of the hook piece from the tab body results in the zipper pull tab falling apart.

U.S. Patent Publication Number US 2002/0069494 A1 to McCrum describes a zipper pull with a U-shaped rod containing hooked ends which are inserted into a handle assembly having a rod passageway cavity and rod engagement cavities. The hooked ends are normally spaced apart by a biasing force of the material composing U-shaped rod. During insertion, the hooked ends are squeezed together by the user for insertion of the hooked ends into the rod passageway. Once inserted into the rod passageway, the resilient U-shaped rod responds to removal of the squeezing pressure, causing the hooked ends to separate and so to enter the rod engagement cavities internally located within the handle assembly.

In addition to the relatively small dimensions of such hooked ends and rod passageways and cavities, which present excessive manufacturing complexity, repeated squeezing of the U-shaped rod to counter its resilience will fatigue the U-shaped rod to lose its resilience, and so the hooked ends may inadvertently slide out of the rod cavities and passageways. In addition, the fatiguing of the U-shaped rod may cause the rod to break.

U.S. Patent Publication Number US 2003/0079317 A1 to Oda describes a pull of a slide including a pull attachment which frictionally engages a pull connecting ring by having an elastic attachment plate on each component interlock to removably attach the pull attachment to the pull connecting ring. To remove the pull attachment from the ring, the user must deform one of the elastic attachment plates in a vertical direction through a through hole.

In addition to the relatively small dimensions of such attachment plates and through holes, which present excessive manufacturing complexity, the frictional engagement causes strain on the elastic attachment plates, which may result in fatigue and wear preventing the attachment plates from maintaining securement between the attachment portion and the connecting ring, and so the attachment plates may inadvertently slide apart, causing the pull to come apart. In addition, the fatiguing of the attachment plates may cause one of the attachment plates to break, rendering either the pull attachment portion or the slider body useless.

U.S. Patent Publication Number US 2003/0079318 A1 to Oda describes a pull of a slider which has a pull connecting ring pivotally and removably engaging a pull main body. Due to the pivoting engagement, the pull may have different orientations, for example, the main body may bend at an angle either toward or away from the user which may obscure any indicia thereon, and so reducing the ornamental aspect of the pull.

Of greater concern, with the main body bent at an acute angle with the tip of the main body directed toward the user, sufficiently hard force on the pull due to a door or a hand hitting the pull may cause the tip of the main body to direct great pressure at the point of contact of the tip with the user, which may result in physical harm to the user.

In addition, known zipper pulls, such as the pivoting assembly in U.S. Patent Publication Number US 2003/0079318 A1 to Oda, do not provide a single uniform and compact appearance.

We have invented a two-part connecting zipper pull which can be readily detached from the zipper slider to repair or replace the zipper pull and/or to provide a different ornamental appearance as desired by the user, as well as providing a single uniform and compact appearance, while avoiding the disadvantages of using a pivoting configuration of the zipper pull.

BRIEF SUMMARY OF THE INVENTION

A two-part connecting zipper pull is disclosed which is useful for repairing broken or damaged zipper pulls. The two-part connecting zipper pull comprises a base member defining at least a pair of apertures spaced apart from each other, each aperture having associated therewith a transverse aperture. A generally U-shaped loop member has a connecting member extending from each end, the connecting members dimensioned and spaced from each other for respective reception into the pair of spaced apertures of the base member in a manner which prevents relative pivoting therebetween, each connecting member having a generally transverse aperture which becomes aligned with the first mentioned transverse apertures in the base member when the loop member is assembled therewith. The invention further comprises an elongated securement pin dimensioned for insertion into the transverse apertures for retention of the members in assembled relation.

A two-part connecting zipper pull is also disclosed which comprises a pull tab including receiving apertures therein; and a connecting aperture. A loop member has ends dimensioned and adapted to be fitted into the receiving apertures, and a securing pin for removably securing the ends of the loop member into the receiving apertures. The ends of the loop member include apertures which align with the connecting aperture of the pull tab for allowing the securing pin to pass therethrough. The pull tab may also include an exposed surface upon which ornamental indicia thereon may be emplaced.

Another embodiment of the two-part connecting zipper pull comprises a pull tab including receiving apertures therein; and a connecting aperture. A loop member has a pair of ends dimensioned and adapted to be fitted into the receiving apertures; and apertures extending through the ends which align with the connecting aperture of the pull tab for allowing a securing pin to pass therethrough to assemble the pull tab and the loop member. The connecting aperture is adapted to receive the securing pin for removably securing the ends of the loop member into the receiving apertures. The pull tab may also include an exposed surface upon which ornamental indicia thereon may be emplaced.

A kit is also disclosed for selectively assembling a customized two-part connecting zipper pull. The kit comprises a plurality of pull tabs, each pull tab including receiving apertures therein; and a connecting aperture. A loop member has a pair of ends to be fitted into the receiving apertures of a selected pull tab of the plurality of pull tabs. A securing pin for removably securing the ends of the loop member into the receiving apertures of the selected pull tab, thereby forming a customized two-part connecting zipper pull, giving the appearance of a unitary pull tab having no pivoting capability.

The ends of the loop member include apertures which align with the connecting aperture of the selected pull tab for allowing the securing pin to pass therethrough. In the kit, at least one pull tab of the plurality of pull tabs includes an exposed surface upon which ornamental indicia thereon may be emplaced.

BRIEF DESCRIPTION OF THE SEVERAL VIEWS OF THE DRAWINGS

Preferred embodiments of the invention are disclosed hereinbelow with reference to the drawings, wherein.

DETAILED DESCRIPTION OF THE INVENTION

Figure 1:
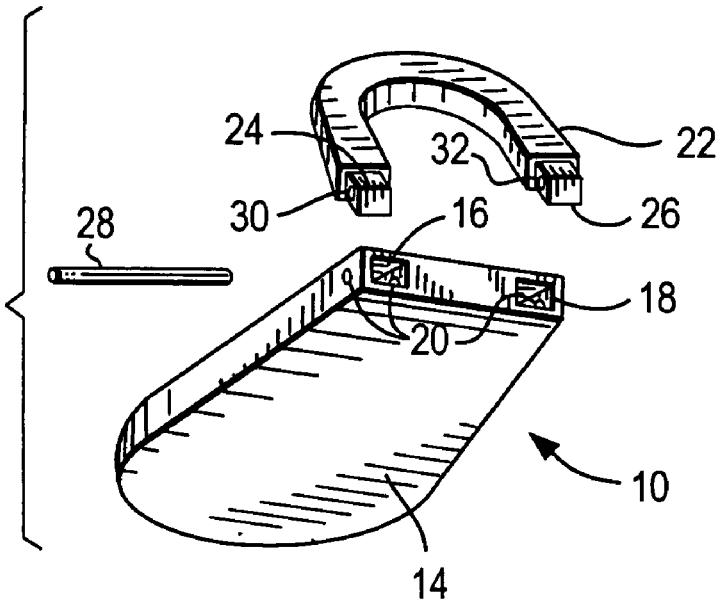
FIG. 1 is a perspective view of the two-part connecting zipper pull of the present invention with parts separated for convenience of illustration.

Referring to FIGS. 1–4, a two-part connecting zipper pull 10 is illustrated which can be readily detached from a zipper slider 12, shown in FIGS. 5–9, to repair or replace the zipper pull 10 and/or to provide a different ornamental appearance as desired by the user.

The two-part connecting zipper pull 10 includes a pull tab 14 as a base member defining at least a pair of receiving apertures 16, 18 therein as apertures spaced-apart from each other, and defining connecting apertures 20 as transverse apertures in the receiving apertures 16, 18. The pull tab 14 and the loop member 22 may each be a single monolithic element as shown, for example, monolithically formed from plastic, metal, or other materials to be rigid.

The zipper pull 10 also includes a loop member 22 being generally U-shaped and having ends 24, 26 to be fitted into the receiving apertures 16, 18 to give the appearance of a single integrally formed pull tab 10. A connecting member extends from each of the ends 24, 26 with the connecting members dimensioned and spaced from each other for respective reception into the pair of spaced-apart apertures 16, 18.

The connecting members of the ends 24, 26 are generally rectangular in shape and cross-section, and are dimensioned for reception into the correspondingly dimensioned and configured receiving apertures 16, 18 of pull tab 14 in a manner which prevents relative pivoting therebetween, with each connecting member having a generally transverse aperture 30, 32 which becomes aligned with the first mentioned transverse apertures 20 in the pull tab 14 when the loop member 22 is assembled therewith.

The zipper pull 10 also includes a securing pin 28 as shown, for removably securing the ends 24, 26 of the loop member 22 into the receiving apertures 16, 18. As shown in FIGS. 2–4 and 6–8, the ends 24, 26 have apertures 30, 32 which align with the connecting apertures 20 of the pull tab 14 when assembled, for allowing the securing pin 28 to pass therethrough.

In a preferred embodiment, the zipper pull 10 is used to repair and/or replace a pre-existing broken zipper pull, in which the securing pin 28 is securely pushed into the aligned apertures 20, 30, 32 and, by a friction fit, is not removable in order to provide a secure assembly of the pull tab 14 and the loop member 22. Accordingly, the components 14, 22, 28 of the zipper pull 10 are part of a repair kit.

Alternatively, the zipper 10 and/or its components 14, 22, 28 may also be original equipment for sale separately. Although the preferred use of the zipper pull 10 is to provide a replaceable repair zipper pull with a non-removable securing pin 28 to provide non-interchangeable pull tabs 14, it is not outside the realm of possibility that one having ordinary skill in the art may contemplate providing removable securing pins 28 to allow a user to interchange different pull tabs 14 for subsequent repairs or for aesthetic purposes.

In alternative embodiments in which the securing pin 28 is removable from the assembled pull tab 14 and loop member 22, the securing pin 28 may be a pressure pin, a small screw, or other known fastening devices for passing through the aligned and mating apertures 20, 30, 32. The removable securing pin 28 is inserted into one of the openings of the connection apertures 20 aligned with the apertures 30, 32, and then is pushed into the apertures 20, 30, 32. In the preferred embodiment, the ends of the securing pin 28 are flush with either or both openings of the connecting apertures 20, or they may be slightly recessed. It is foreseeable that persons skilled in the art may structure the securing pin 28 to be easily removable by a user as by extending the pin 28 beyond the structure, or by providing threads to permit screwing the pin 28 in place.

Figure 2:
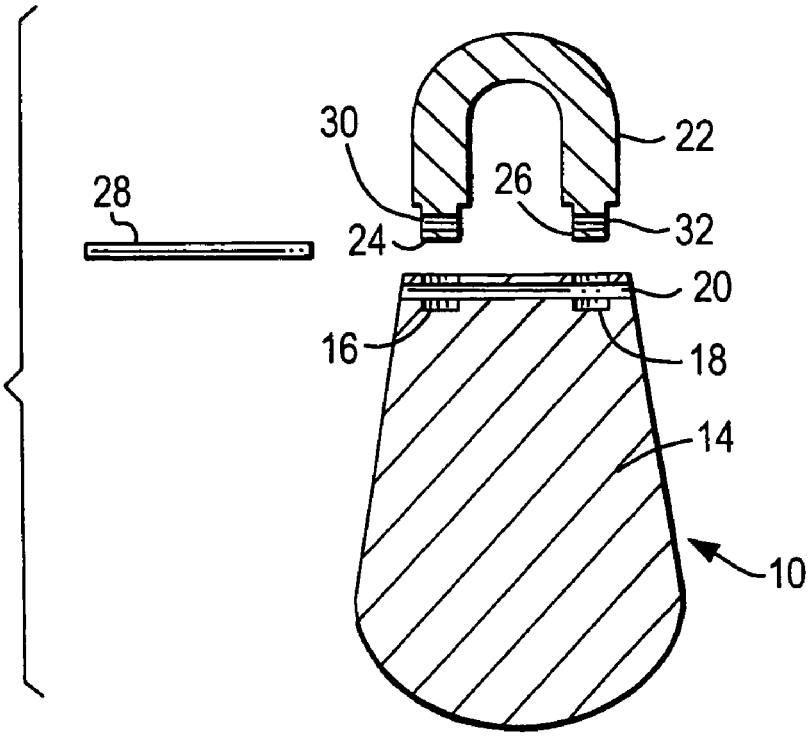
FIG. 2 is a front elevational cross-sectional view of the zipper pull of FIG. 1.

As shown and described herein, FIG. 1 is a perspective view of the two-part connecting zipper pull 10 of the present invention with parts separated, and FIG. 2 is a front elevational cross-sectional view of the zipper pull 10 of FIG. 1. The zipper pull 10 and its components shown herein may be fabricated from metal, plastic, or other materials by known processes.

In the exemplary embodiment shown in the FIGS., the loop member 22 is U-shaped, with male ends 24, 26 dimensioned to be almost the same size as the complementary female receiving apertures 16, 18 in order to assume a tightly fitting assembly.

Figure 3:
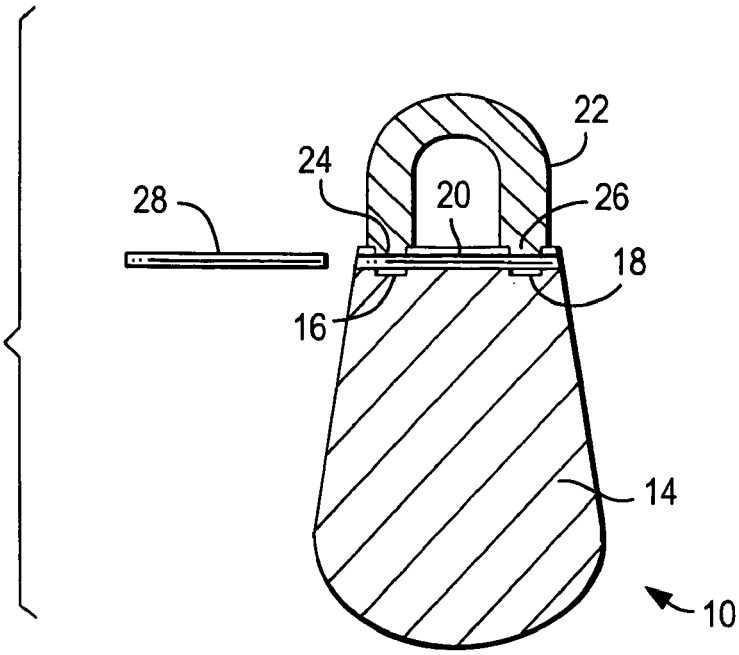
FIG. 3 is a front elevational cross-sectional view of the zipper pull of FIG. 1 in a partially assembled condition.

FIG. 3 is a front elevational cross-sectional view of the zipper pull 10 in a partially assembled condition, with each end 24, 26 slipped into and mating with the respective receiving aperture 16, 18. In the condition shown in FIG. 3, the apertures 30, 32 in each respective end 24, 26 align with the connecting apertures 20, forming a contiguous slot passing from one side to the other of the pull tab 14 for receiving the securing pin 28.

Figure 4:
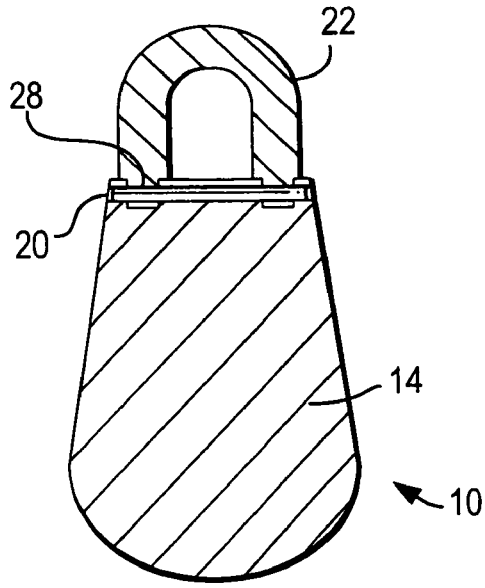
FIG. 4 is a front elevational cross-sectional view of the zipper pull of FIG. 1 in a fully assembled condition.

FIG. 4 is a front elevational cross-sectional view of the zipper pull 10 in a fully assembled condition, in which the securing pin 28 has been passed through and rests in the contiguous slot formed by the aligned apertures 20, 30, 32. Accordingly, the loop member 22 is removably secured to the pull tab 14 by the securing pin 28. Since the configuration shown in FIG. 4 is separate and distinct from the zipper slider 36, the zipper pull 10 may be provided separately in this configuration for future attachment to zipper sliders 36 of any number of types, as described, for example, with reference to FIGS. 5–9.

Figure 5:
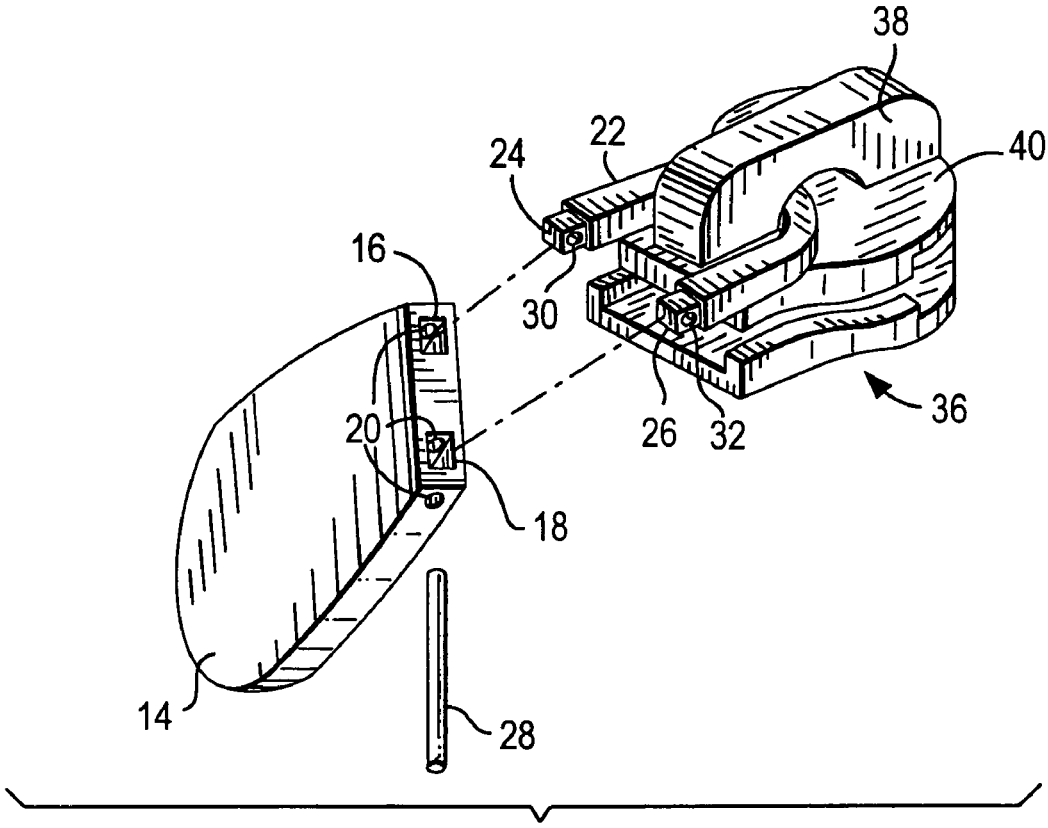
FIG. 5 is a right side perspective view from above, of the two-part connecting zipper pull of the present invention with parts separated in relation to a typical zipper slider.
Figure 6:
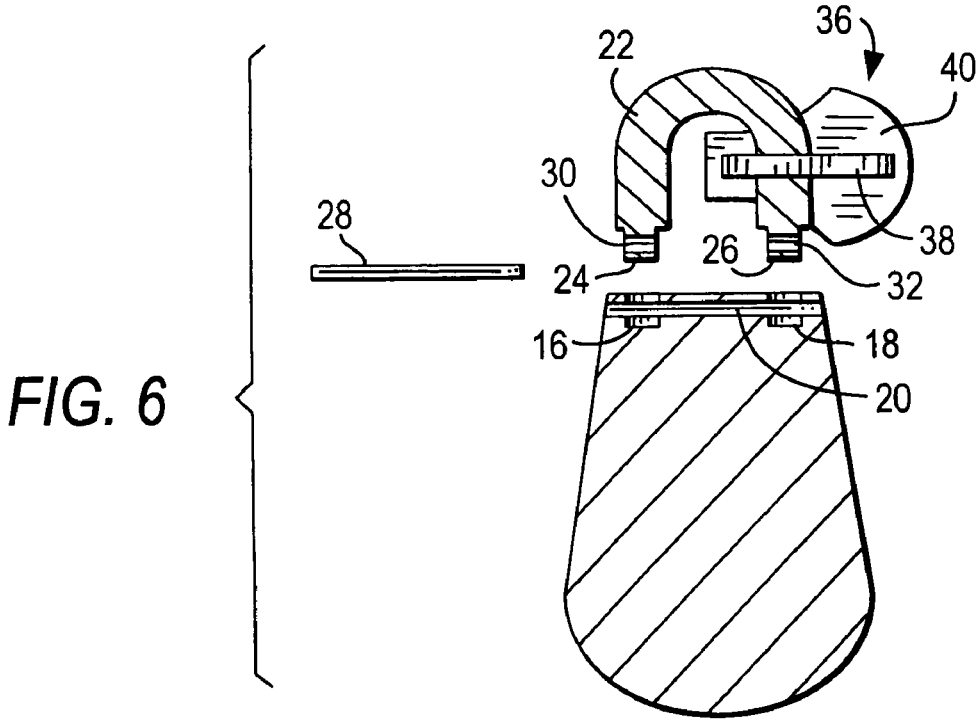
FIG. 6 is a front elevational cross-sectional view of the zipper pull of FIG. 5 in position with respect to the zipper slider.

FIG. 5 is a perspective view of the two-part connecting zipper pull 10 of the present invention with parts separated in relation to an exemplary zipper slider 12, and FIG. 6 is a front elevational cross-sectional view of the zipper pull 10 of FIG. 5 coupled around the zipper slider 12 and in partially assembled condition. The zipper slider 36 includes a connecting arch 38 which extends from the crown 40, and may be fabricated in a manner known in the art, such as the zipper slider 36 shown and described in U.S. Pat. No. 6,035,497, the disclosure of which is incorporated by reference herein and made a part of this disclosure.

As shown in FIG. 5, the loop member 22 is unattached with respect to the pull tab 14 and is passed through the connecting arch 38, with the ends 24, 26 positioned for mating with the respective receiving apertures 16, 18 of the pull tab 14.

Figure 7:
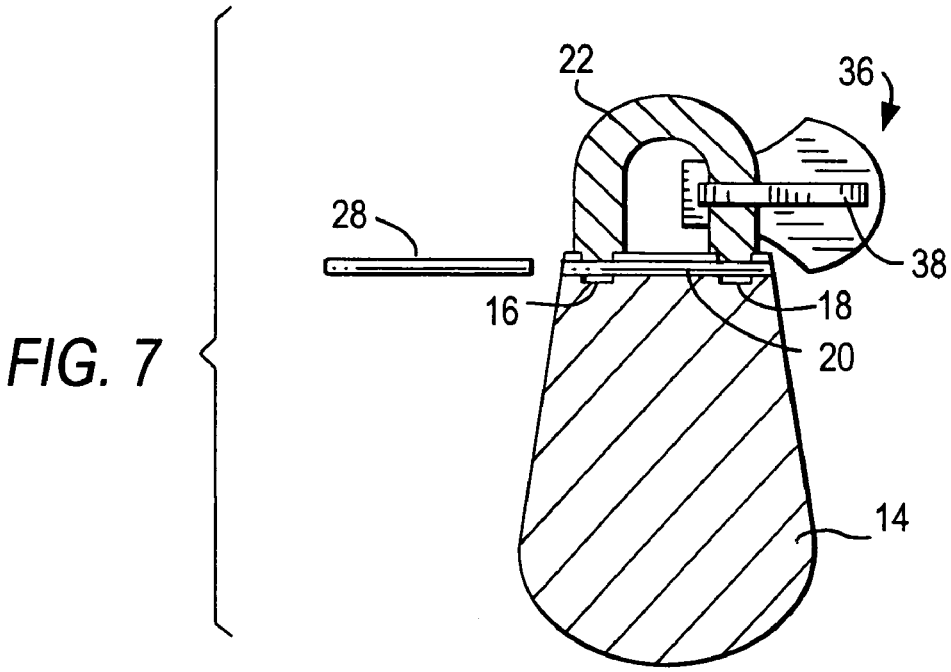
FIG. 7 is a front elevational cross-sectional view of the zipper pull of FIG. 5 in a partially assembled condition.

FIG. 7 is a front elevational cross-sectional view of the zipper pull 10 in a partially assembled condition, with each end 24, 26 slipped into and mating with the respective receiving aperture 16, 18, and with the loop member 22 extending through the arch 36. In the condition shown in FIG. 7, the apertures 30, 32 in each respective end 24, 26 align with the connecting apertures 20, forming a contiguous slot passing from one side to the other of the pull tab 14 for receiving the securing pin 28.

Figure 8:
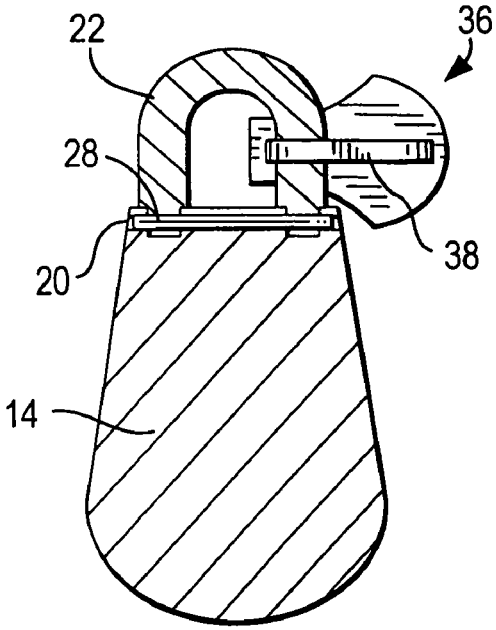
FIG. 8 is a front elevational cross-sectional view of the zipper pull of FIG. 5 in a fully assembled condition with respect to the zipper slider.

FIG. 8 is a front elevational cross-sectional view of the zipper pull 10 in a fully assembled condition, in which the securing pin 28 has been passed through and rests in the contiguous slot formed by the aligned apertures 20, 30, 32.

In this condition, the zipper slider 38 cannot be removed from the assembled zipper pull 10 until the securing pin 28 is removed from the aligned apertures 20, 30, 32. Accordingly, the loop member 22 is removably secured to the pull tab 14 by the securing pin 28, and the pull tab 10 can be readily removed from the zipper slider 38, for example, if the pull tab 10 and/or the zipper slider 38 is damaged, or if the user desires to change the ornamental appearance of the zipper pull 10 by changing the pull tab 14.

Figure 9:
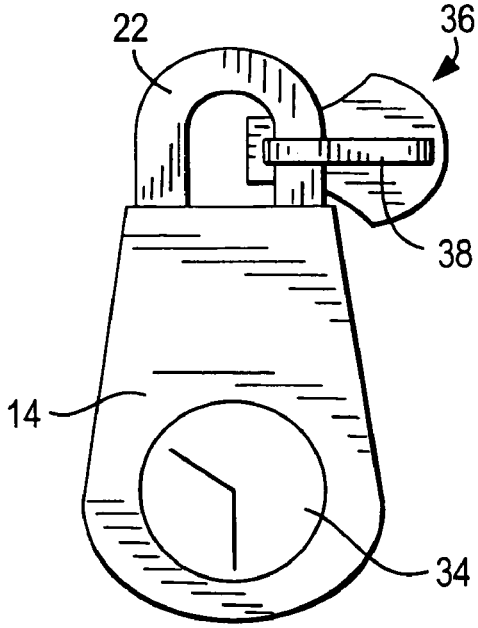
FIG. 9 is a front elevational view of the zipper pull in a fully assembled condition with respect to the zipper slider.

For example, FIG. 9 shows a front elevational view of the zipper pull 10 in a fully assembled condition with the zipper slider 12, with the pull tab 14 having ornamental indicia 34, which may include different colors and patterns, emplaced on an exposed surface of the pull tab 14, such as the depiction of a clock face, for example.

The components 14, 22, 28 of the two-part connecting zipper pull 10 disclosed herein may be provided separately, or packaged and/or sold together as a kit for selectively assembling a customized two-part connecting zipper pull. The kit may include any number of combinations of items. For example, one kit may include a plurality of pull tabs 14, with each pull tab 14 including the receiving apertures 16, 18 therein; and a connecting aperture 20; one or more loop members 22 having ends 24, 26 to be fitted into the receiving apertures 14, 16 of a selected pull tab 14 of the plurality of pull tabs; and one or more securing pins 28 for removably securing the ends 24, 26 of the at least one loop member 22 into the receiving apertures 16, 18 of the selected pull tab 14, thereby forming a customized two-part connecting zipper pull 10.

For example, a first selected pull tab without indicia may be connected to the loop member 22 to form a first customized embodiment of the two-part connecting zipper pull shown in FIG. 8, while a second selected pull tab with exposed indicia 34 thereon may be connected to the loop member 22 to form a second customized embodiment of the two-part connecting zipper pull shown in FIG. 9 having indicia 34.

In selecting pull tabs 14, the user may be given the choice of different styles, shapes, colors, logos, words, textures, and combinations thereof. In one embodiment, the indicia 34 may include Braille for use by the blind to identify the compartments, accessible by the corresponding pull tab 14, of their carry cases, such as the Braille symbols for "plane ticket", "eyeglasses", "keys", etc.

In another use, parents may selectively color-code their carry cases for use when traveling with their infants, and include white indicia 34 on a first pull tab to represent diapers, for example, stored in the accessible compartment associated with the first pull tab, while pink indicia 34 on a second pull tab may represent clothes in the corresponding compartment thereof.

In further uses, one may select different pull tabs 14 having characteristics associated with one's tastes, such as soft surfaces composed of leather or suede mounted as the indicia 34 on the exposed portion of the pull tabs 14. Rubberized surfaces as the indicia 34 may also be provided to facilitate grasping and pulling the pull tabs 14.

Finally, the kit of the present invention can be sold as an after-market zipper kit for all items incorporating zipper closures, such as luggage, clothing, handbags or the like, thus avoiding the need to discard the product.

While the invention has been shown and described with respect to preferred embodiments, it will be understood by those skilled in the art that various modification and changes may be made therein without departing from the spirit and scope of the invention.

What is claimed is:

1. A two-part connecting zipper pull which comprises:

a) a base member defining at least a pair of apertures spaced apart from each other, each said aperture having associated therewith a transverse aperture;

b) a generally U-shaped loop member having a connecting member extending from each end, said connecting members dimensioned and spaced from each other for respective reception into said pair of spaced apertures of said base member in a manner which prevents relative pivoting therebetween, each said connecting member having a generally transverse aperture which becomes aligned with said first mentioned transverse apertures in said base member when said loop member is assembled therewith; and c) an elongated securement pin dimensioned for insertion into said transverse apertures for retention of said members in assembled relation.

2. A two-part connecting zipper pull which comprises:

a pull tab including:

a first pair of spaced apart apertures therein; and a connecting aperture associated with the first pair of apertures for reception of a securing pin;

a loop member having a pair of ends dimensioned and adapted to be fitted into and removed from the first pair of spaced apart apertures, said pair of ends having an outer configuration which substantially complements said first pair of spaced apart apertures when said pair of ends are inserted therein, so as to prevent relative pivoting between the loop member and the pull tab, and said pair of ends permit the loop member to be completely separated from the pull tab; and wherein the securing pin is insertable into the connecting aperture for removably securing the ends of the loop member into the first pair of apertures.

3. A two-part connecting zipper pull which comprises:

a pull tab including:

a pair of receiving apertures therein; and a connecting aperture;

a loop member having a pair of ends dimensioned and adapted to be fitted into the receiving apertures, said ends each having an outer configuration which substantially complements each said respective receiving aperture when said ends are respectively inserted therein, thereby preventing relative pivoting of the loop member and the pull tab; and a securing pin for removably securing the ends of the loop member into the receiving apertures;

wherein the ends of the loop member include apertures which align with the connecting aperture of the pull tab for allowing the securing pin to pass therethrough.

4. The two-part connecting zipper pull of claim 2, wherein the pull tab includes:

an exposed surface upon which ornamental indicia thereon may be emplaced.

5. A two-part connecting zipper pull which comprises:

a pull tab including:

receiving apertures therein; and a connecting aperture;

a loop member including:

a pair of ends dimensioned and adapted to be fitted into the receiving apertures, said pair of ends each having an outer configuration which substantially complements each said respective receiving aperture when said pair of ends are respectively inserted therein, thereby preventing relative pivoting between the loop member and the pull tab; and apertures extending through the ends which align with the connecting aperture of the pull tab for allowing a securing pin to pass therethrough to assemble the pull tab and the loop member; and wherein the connecting aperture is adapted to receive the securing pin for removably securing the ends of the loop member into the receiving apertures.

6. The two-part connecting zipper pull of claim 5, wherein the pull tab includes:

an exposed surface upon which ornamental indicia thereon may be emplaced.

7. A kit for selectively assembling a customized two-part connecting zipper pull, the kit comprising:

a plurality of pull tabs, each pull tab including:

a first pair of spaced apart apertures therein; and a connecting aperture associated with the first pair of apertures for reception of a securing pin;

a loop member having a pair of ends dimensioned and adapted to be fitted into and removed from the respective first pair of apertures of a selected pull tab of the plurality of pull tabs, said pair of ends each having an outer configuration which substantially and respectively complements said first pair of spaced apart apertures when said pair of ends are respectively inserted therein, thereby preventing relative pivoting of the loop member and the selected pull tab, and said pair of ends permit the loop member to be completely removed from the selected pull tab; and wherein the securing pin is insertable into the connecting aperture for removably securing the ends of the loop member into the respective first pair of apertures of the selected pull tab, thereby forming the customized two-part connecting zipper pull.

8. A kit for selectively assembling a customized two-part connecting zipper pull, the kit comprising:

a plurality of pull tabs, each pull tab including:

a first pair of spaced apart apertures therein; and a connecting aperture associated with the first pair of apertures for reception of a securing pin;

a loop member having a pair of ends dimensioned and adapted to be fitted into the first pair of apertures of a selected pull tab of the plurality of pull tabs, each said pair of ends having an outer configuration which substantially and respectively complements said first pair of spaced apart apertures when said pair of ends are respectively inserted therein, thereby preventing relative pivoting of the loop member and the selected pull tab; and wherein the securing pin is insertable into the connecting aperture for removably securing the ends of the loop member into the first pair of apertures of the selected pull tab, thereby forming the customized two-part connecting zipper pull;

wherein the ends of the loop member include apertures which align with the connecting aperture of the selected pull tab for allowing the securing pin to pass therethrough.

9. The kit of claim 8, wherein at least one pull tab of the plurality of pull tabs includes:

an exposed surface upon which ornamental indicia thereon may be emplaced.

* * * * *